United States Patent [19]

Goto et al.

[11] Patent Number: 4,853,736

[45] Date of Patent: Aug. 1, 1989

[54] IMAGE FORMING APPARATUS

[75] Inventors: Koji Goto, Kawasaki; Teigo Sakakibara, Yokohama, both of Japan

[73] Assignee: Canon Kabushiki Kaisha, Tokyo, Japan

[21] Appl. No.: 208,213

[22] Filed: Jun. 17, 1988

[30] Foreign Application Priority Data

Jun. 18, 1987 [JP] Japan ..... 62-150184

[51] Int. Cl.[4] ..... G03G 15/00

[52] U.S. Cl. ..... 355/210; 355/274; 355/219; 355/229; 355/221

[58] Field of Search ..... 355/3 TR, 3 R, 15, 77, 355/14 E, 3 CH; 430/31, 48, 97, 126

[56] References Cited

U.S. PATENT DOCUMENTS

| | | | |
|---|---|---|---|
| 4,348,098 | 9/1982 | Koizumi | 355/3 TR |
| 4,364,661 | 12/1982 | Landa | 355/3 TR |
| 4,477,176 | 10/1984 | Russel | 355/3 TR |
| 4,538,901 | 9/1985 | Soumiya | 355/15 X |
| 4,669,854 | 6/1987 | Ichikawa et al. | 355/3 R |

*Primary Examiner*—R. L. Moses

*Attorney, Agent, or Firm*—Fitzpatrick, Cella, Harper & Scinto

[57] ABSTRACT

There is provided an image-forming device including: a photosensitive member having a photosensitive layer including an organic photoconductive material, a charging devices, an image exposure devices for exposing the pre-transfer material to form a latent image, a developing devices for developing the latent image with a toner to form a transferable toner image on the surface of the photosensitive member, a pre-transfer exposure devices for exposing the photosensitive member carrying the toner image, and a transfer devices for transferring the toner image to a transfer material; the charging devices, image exposure devices, developing devices pre-transfer exposure devices, and transfer devices are disposed in this order along the moving direction of the photosensitive member; wherein the light from the pre-transfer exposure devices is scattered light and the intensity of the scattered light is two or more times that of the light used for the image exposure. Such an image-forming devices can stably transfer a toner image from a photosensitive member to a transfer material and can provide an image of good quality without a ghost image.

7 Claims, 1 Drawing Sheet

IMAGE FORMING APPARATUS

FIELD OF THE INVENTION AND RELATED ART

The present invention relates to an image-forming apparatus utilizing an electrostatic transfer process such as an electrostatic copying machine, an electrostatic printer, etc., and particularly to an image-forming apparatus using a photosensitive member comprising an organic photoconductive material.

Heretofore, there has been known an image-forming apparatus for practicing an electrophotographic process repeatedly. In such a electrophotographic process, a transfer material such as paper is caused to contact a transferable toner image formed on a photosensitive member (or image-carrying member) thereby to transfer the toner image to the transfer material by means of a transfer charger; the transfer material is electrostatically separated from the photosensitive member by means of a separation charger and supplied to the subsequent step; and a residual charge and a residual toner not contributing to the transfer and remaining on the photosensitive member surface are removed by means of a pre-exposure means and a cleaner.

In such an image-forming apparatus, in order to electrostatically separate the transfer material form the photosensitive member after the transfer of a toner image, in the case of normal development, the transfer material is supplied with a charge having a polarity reverse to the charge which has been imparted to the transfer material at the time of transfer (i.e., a charge having the same polarity as that of the toner), thereby to discharge the transfer material. In such a discharge method, there is liable to occur a back-transfer (or re-transfer) phenomenon, i.e., one such that a part of the toner once transferred to the transfer material is again transferred to the photosensitive member because of the residual latent image potential remaining on the photosensitive member, or because of an excess discharge caused by too strong of separation charging, etc. As a result, there can occur an image defect such as a decrease in transfer efficiency, decrease in image density, and image unevenness.

It has been known that, in order to prevent such occurrence of back-transfer, the latitute in the separation charging is extended by disposing a grid in the separation charger, for example. However, when such a grid, i.e., a charging wire of the separation charger, is used, the grid is liable to be contaminated by paper powder, floating toner particles, etc., due to its position. As a result, because of abnormal discharge caused by such contamination, a partial dielectric breakdown occurs to the photosensitive member to cause white dots (in the case of normal development), or black dots (in the case of reversal development) on the surface of the resultant copied image, whereby image defects occur.

Alternatively, as disclosed in Japanese Patent Publication (JP-B, Kokoku) No. 11576/1974, Japanese Laid-Open Patent Application (JP-A, Kokai) Nos. 60473/1981, and 104164/1982, for example it has been known that the photosensitive layer disposed on the surface of a photosensitive member is entirely exposed after a latent image formed thereon is developed with a toner and before the resultant toner image is transferred to a transfer material such as paper, whereby the surface potential of the photosensitive layer is decreased.

For example, Japanese Laid-Open Patent Application No. 104164/1982 discloses that a light quantity of about 10–100 lux.sec is required for exposure on to a photosensitive drum obtained by vacuum evaporation of selenium or a selenium-type substance, in order to erase the surface charge by exposing the photosensitive member by the medium of toner particles attached thereto; that a white fluorescent lamp is suitably used as the light source for such exposure; and that when a photosensitive member is exposed so that substantially no light having a wavelength of 600 nm or larger is transmitted, e.g., by disposing a blue filter in front of the light source, an electrostatic force on the photosensitive member surface is removed, and there occurs no ghost image based on fatigue of the photosensitive member, in the next copying process.

Heretofore, inorganic semiconductors such as selenium, selenium-arsenic, and selenium-tellurium, have been widely used for the photosensitive member. However, there have recently been developed photosensitive members using an organic photoconductive material (or organic photoconductor) as the photosensitive layer thereof, in view of advantages such as ease in the synthesis and production thereof, reduction in cost, and free controllability of the photosensitive characteristic thereof, as disclosed in U.S. Pat. Nos. 4,123,270, 4,251,613, and 4,260,672. Among these, in practice, the following have widely been used practically a function-separation-type photosensitive member which uses charge-generating material having a charge-generating function represented by azo pigments as disclosed in U.S. Pat. Nos. 4,356,243, 4,471,040, for instance, etc., phthalocyanine pigments as disclosed in U.S. Pat. No. 4,535,043, etc.; and a charge-transporting material having a chargetransporting function represented by hydrazone disclosed in U.S. Pat. No. 4,423,129, stilbenes as disclosed in U.S. Pat. No. 4,245,021, etc.

However, in the photosensitive member using such organic photoconductive material, the lifetime of charge carriers generated by light irradiation is relatively long and the mobility of the carriers is relatively small as compared with the case of the photosensitive member using an inorganic semiconductor such as selenium. Accordingly, when the photosensitive member using the organic photoconductive material is subjected to pre-transfer exposure, e.g., in the case of normal development, a non-image portion (i.e., a portion not supplied with a toner image) of the photosensitive member is subjected to a larger quantity of light than that in an image portion because the pre-transfer exposure is effected on the photosensitive member surface on which the toner image is present. As a result, a difference in optical fatigue occurs between these portions, and such difference is not completely removed at the discharge step after the cleaning step for the residual toner, which remains on the photosensitive member thereby causing image unevenness, i.e., a so-called ghost image, in the subsequent electrophotographic process.

SUMMARY OF THE INVENTION

An object of the present invention is to solve the above-mentioned problems conventionally encountered in a type of image-forming apparatus which uses an organic photoconductive material as a photosensitive member and to ensure improvement in image quality and the separability of a transfer material by a pre-transfer exposure.

Another object of the present invention is to provide an image-forming apparatus which can stably transfer a toner image from a photosensitive member to a transfer material and can provide an image of good quality without a ghost image.

According to the present invention, there is provided an image-forming apparatus including: a photosensitive member having a photosensitive layer comprising an organic photoconductive material, a charging means, an image exposure means for exposing the photosensitive member to form a latent image, a developing means for developing the latent image with a toner to form a transferable toner image on the surface of the photosensitive member, a pre-transfer exposure means for exposing the photosensitive member carrying the toner image, and a transfer means for transferring the toner image to a transfer material. The charging means, image exposure means, developing means, pre-transfer exposure means, and transfer means are disposed in this order along the moving direction of the photosensitive member wherein the light from the pre-transfer exposure means is scattered light and the intensity of the scattered light is two or more times that of the light used for the image exposure exerted by the image exposure means.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
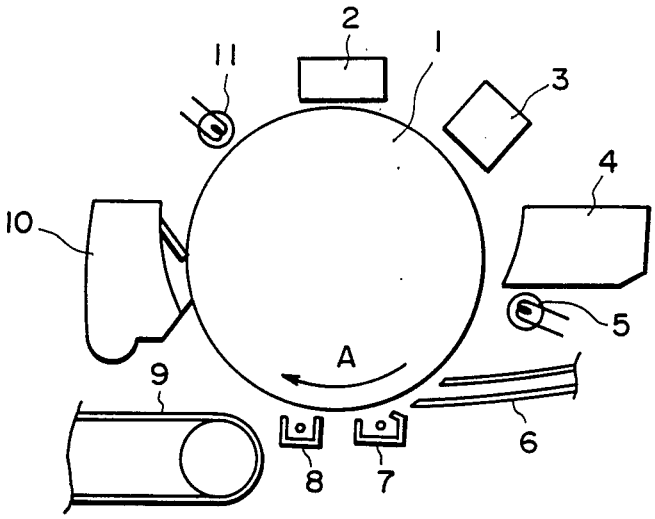
FIG. 1 is a schematic side view of an essential part of an embodiment of the copying machine to which the present invention is applicable.

In the image-forming apparatus according to the present invention, scattered light is used for pre-transfer exposure and the light quantity of scattered light is two or more times that of image exposure for forming a latent image on the surface of a photosensitive member. Hereinbelow, the function of such scattered light is described in detail.

In the above-mentioned apparatus, the charge to be removed or erased by the pre-tranfser exposure is one prsent on the photosensitive member surface which is disposed under a toner image. Accordingly, in order to remove the charge of the photosensitive member disposed under the toner image by using a light beam having strong directivity such as a laser beam and an LED beam, a large quantity of light is required. As a result, in a photosensitive member using an organic semiconductor, there occurs a large difference in optical fatigue between an image portion (i.e., a portion on which the toner image is present), and a non-image portion (i.e., a portion on which the toner image is not present). Further, as described above, such a large difference is not completely removed at a discharge step after a cleaning step for the residual toner which remains on the photosensitive member, whereby the difference in optical fatigue appears as a ghost image in the subsequent electrophotographic process.

Further, the toner image generally comprises toner particles having a particle size of about 5–15 μm in an aggregated or agglomerated state. Therefore, when the pre-transfer exposure is effected by using the light beam having a strong directivity, only rays having a direction substantially perpendicular to the toner image surface arrive at the toner image surface, whereby a large portion of the incident rays are reflected by the toner image and returned. As a result, the proportion of the rays arriving at the photosensitive member surface under the toner image is decreased.

In the present invention, however, the pre-transfer exposure is effected by using scattered rays having a light intensity (i.e., light quantity per unit time) which is two or more times that of the image exposure, and the scattered rays comprise those having various incident angles in addition to those having a direction perpendicular to the toner image surface. Therefore, the quantity of rays which pass through the toner particles to arive at the photosensitive member surface disposed under the toner image is increased. Further, incident rays arriving at the periphery of the toner image also effectively function, in addition to those arriving at the photosensitive member surface under the toner image. As a result, in the present invention, the photosensitive member can be effectively discharged without causing a large difference in optical fatigue by using a relatively small quantity of light, whereby not only good separability of a transfer material such as paper from the photosensitive member is maintained, but also an image of good quality is provided without causing a ghost image. Further, because the photosensitive member surface under the toner image is effectively discharged by the above-mentioned pre-transfer exposure, the toner particles are easily transferred from the photosensitive member to the transfer material at the transfer step, without causing the above-mentioned back-transfer of toner particles.

Hereinbelow, there is described a preferred embodiment of the image-forming apparatus according to the present invention with reference to FIG. 1.

FIG. 1 is a schematic side view showing an essential part of an embodiment of a copying apparatus to which the present invention is suitably applied. Referring to FIG. 1, the copying apparatus comprises a rotating cylindrical photosensitive member 1 and around the photosensitive member 1, a primary charger 2, an image exposure means 3 for forming an electrostatic latent image, a developing apparatus 4 for developing the latent image with a toner (not shown) to form a toner image, a light source 5 for pretransfer exposure, a feeder 6 for a transfer material (not shown), a transfer charger 7 for transferring the toner image from the photosensitive member 1 onto the transfer material, a separation charger 8 for separating the transfer material from the photosensitive member 1, a conveyor 9 for conveying the separated transfer material, a cleaner 10, and a discharge (or charge-removing) lamp 11 for erasing remaining charge on the photosensitive member 1.

In operation, the photosensitive layer constituting the surface of the photosensitive member 1 rotating in the direction of an arrow A is charged by the primary charger 2 disposed around the photosensitive member 1. Then, the photosensitive member surface is subjected to imagewise exposure corrsponding to image information by the image exposure means 3 whereby an electrostatic latent image is formed on the photosensitive member surface.

Thereafter, the latent image is moved to a developing position where the developing apparatus 4 is disposed opposite to the photosensitive member 1, and supplied with toner particles to be developed.

After the resulant toner image formed by the development passes the developing position and before it reaches a transfer position where the transfer charger 7 is disposed opposite to the photosensitive member 1, the photosensitive member surface carrying the toner image is subjected to pre-transfer exposure by means of the light source 5, whereby unnecessary charge is removed, i.e., the surface potential of the photosensitive member 1 is suitably decreased. Thereafter, the toner image-carrying surface of the photosensitive member 1 reaches the transfer position where the transfer charger 7 is disposed opposite to the photosensitive member 1, and the toner image is transferred to a transfer material such as paper (not shown) supplied from the feeder 6. Then, the transfer material is separated from the photosensitive member 1 under the action of the separation charger 8, and conveyed to a fixing position (not shown) by means of a conveyor 9.

Foreign substances attached to the photosensitive member 1 including residual toner particles which have contributed to the transfer and remain on the photosensitive member surface are removed by means of the cleaner 10, and the remaining charge on the photosensitive member is erased by means of the discharge lamp 11. Further, the specific portion of the photosensitive member 1 again reaches the position where the primary charger 2 is disposed opposite to the photosensitive member 1, and is subjected to the next electrophotographic process.

In the present invention, the light source 5 for the pre-transfer exposure, may preferably be a line source such as a fuselamp, (e.g., a tungsten lamp manufactured by Toshiba K.K.) a line-filament lamp, and an LED array. The "line source" used herein is a linear light source which is disposed in parallel with the surface of the photosensitive member and in a direction perpendicular to the moving direction of the photosensitive member.

The scattered light rays to be supplied to the photosensitive member may preferably be those obtained by scattering rays emitted by the above-mentioned light source by the medium of a scattering means such as a diffusing plate and a diffusing reflector plate; and those obtained by scattering such rays by other appropriate known means. Particularly, rays scattered by a scattering means such as a diffusing plate and a diffusing reflector plate act as those emitted by a surface illuminant to the photosensitive member, whereby there are obtained more random scattered rays, and more suitable and uniform light quantities thereof.

In the present invention, the scattered light used for the pre-transfer exposure may preferably show a scattering rate of 0.5–1, more preferably 0.7–1, particularly preferably 0.9–1. The "scattering rate" used herein may preferably be measured as follows:

An aperture plate having a circular aperture with a diameter of 4 mm is disposed above the surface of a cylindrical member (i.e., a member corresponding to a photosensitive member), e.g., having a diameter of 80 mm, so that the distance between the aperture plate and a point (hereinafter referred to as "first measurement point") on the peripheral surface of the cylindrical member is 7 mm, and that the direction of the aperture plate is parallel to the line to the peripheral surface at the first mesurement point. Then, a diffusing plate as a scattering means is disposed, e.g., on the upper side of the aperture member (i.e., on the side thereof nearer to a light source mentioned hereinafter), so that the center of the bottom surface of the diffusing plate contacting the aperture plate corresponds to the center of the aperture of the aperture plate. Further, a light source is disposed above the diffusing plate so that the distance between the light source and the cylindrical member surface is, e.g., 18 mm, and that the light source, the center of the aperture, the first measurement point and the center of the cylindrical member are arranged in a straight line. In such an arrangement a second measurement point is set on the peripheral surface of the cylindrical member (e.g., upstream or downstream of the first measurement point with respect to a direction perpendicular to the rotating direction of the cylindrical member), so that the line joining the aperture center and the first measurement point, and the line joining the aperture center and the second measurement point form an angle of 45°.

When the light intensity measured at the first measurement point is represented by $I_O$, and that measured at the second measurement point is represented by $I_1$, the ratio of $I_2$ to $I_0$ ($I_1/I_0$) is the abovementioned scattering rate. The light intensities $I_0$ and $I_1$ may be measured by means of a photocell for measuring a light quantity. Further, in the above calculation of the ratio ($I_1/I_0$), the light intensity $I_1$ is so corrected that it may correspond to a hypothetical distance between the aperture center and the second measurement point which is equal to the actual distance between the aperture center and the first measurement point.

In the present invention, it is required that the light intensity of the light used for the pre-transfer exposure is two or more times that of the light used for the image exposure. In view of the prevention of a ghost image, the light intensity of the pre-transfer exposure may preferably be 10 times or less, more preferably 5 times or less, that of the image exposure. The light intensities for the pretransfer exposure and the image exposure are measured at the surface of the photosensitive member 1.

The "image exposure" used herein as the standard of the light intensity is that measured when the photosensitive member is entirely exposed. The light intensity may preferably be measured, e.g., by means of a photocell using a silicone-type photoelectric device (PB 1018, manufactured by Matsushita Electric K.K.). More specifically, the light intensity is measured by removing a photosensitive member, and disposing the photocell at a position corresponding to the image exposure position or pre-transfer exposure position on the photosensitive member surface.

The position of the pre-transfer exposure means can appropriately be determined as long as it is downstream of the developing position and upstream of the transfer position.

In view of the effect of the heat generated by the light source for the pre-transfer exposure on the developing means, the position thereof may preferably be nearer to the transfer position.

The present invention is also applicable to other image-forming apparatus, in addition to the above-mentioned copying apparatus.

Hereinbelow, specific embodiments of the present invention will be described by way of examples.

Example 1

Figure 2:
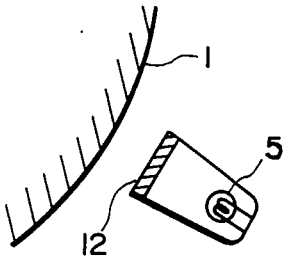
FIG. 2 is a schematic partial side view of an embodiment using a diffusing plate as a means for forming scattered light.

There was provided an electrophotographic copying apparatus (NP-3525, manufactured by Canon K.K.) which had the same arrangement as shown in FIG. 1, and comprised a halogen lamp for a copier (80 V, 240 W) as an image exposure means 3, an LED array (24 V, peak wavelength: 565 nm manufactured by Toshiba K.K.) as a pretransfer exposure means 5, and an electrostatic separation means 8 for the separation of a transfer material. The distance between a photosensitive member 1 and the LED array 5 was set to 18 mm. Further, as shown in FIG. 2, a diffusing plate 12 (10 mm×300 mm, thickness: 2 mm, Dialite P-1436, manufactured by Mitsubishi Rayon K.K.) was provided in front of the LED array 5, so that the distance between the diffusing plate 12 and the photosensitive member 1 was 7 mm. In this arrangement, light from the LED array 5 passed through the diffusing plate 12 to be converted into scattered light, as shown in FIG. 2.

The photosensitive member comprised a photosensitive layer having a laminate structure comprising a charge generation layer and a charge transport layer. More specifically the photosensitive member for electrophotography was one prepared by coating an Al cylinder of 80 mm-dia. ×360 mm-length successively with a 0.5 mm-thick undercoat layer, a 0.1 μm-thick charge generation layer and a 19 μm-thick charge transport layer in this order.

The undercoat layer comprised a polyamide (Amilan CM-8000, manufactured by Toray K.K.). The charge generation layer was composed of 2.5 parts (wt. parts) of an azo pigment as a charge generating material represented by the formula:

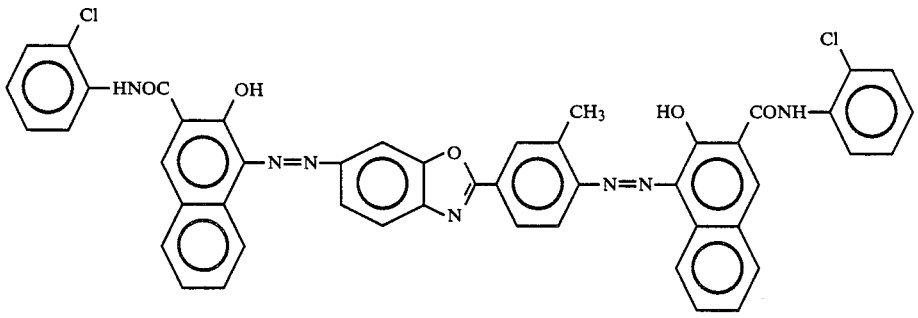

and 1 part of a benzal resin. The charge transport layer was composed of 9.5 parts (wt. parts) of p-diethylaminobenzaldehyde-α-naphthylphenylhydrazone as a charge-transporting material and 10 parts of polycarbonate Z. The photosensitive member 1 having such structure was assembled in the above-mentioned copying apparatus.

By using this copying apparatus, the backtransfer of a toner, the transfer rate of the toner, the occurrence of a ghost image, and the change in dark part potential at the transfer position were measured while changing the ratio of the light intensity of the pre-transfer exposure to that of the image exposure. Incidentally, the respective exposure light intensities (lux) were measured at the surface of the photosensitive member 1 by means of a photocell having an area of 10 mm×17 mm (PB 1018, manufactured by Matsushita Electric K.K.). Further, the scattering rate of the scattered light as defined above was 0.9.

The thus obtained results are shown in the following Table 1. In, in Table 1, the light intensities were divided by the process speed to be converted into light quantities (lux.sec) per unit length. Further, the toner used herein was a black magnetic toner having average particle size of 15 μm, and the transfer material was copy paper.

TABLE 1

| Ratio of light quantity for pre-transfer exposure to that for image exposure | Back-transfer of toner | Transfer rate (%) | Ghost image | Dark part potential after pre-transfer exposure (V) |
|---|---|---|---|---|
| None | Observed | 89 | None | −600 |
| 1 (3.2 lux.sec) | Substantially None | 93 | " | −280 |
| 2 | None | 95 | " | −200 |
| 3 | " | 96 | " | −140 |
| 5 | " | 96 | " | −60 |
| 10 | " | 96 | Slightly observed | −20 |
| 20 | " | 96 | Observed | −20 |

The evaluation standards for the respective items are as follows: (Back-transfer)

An original solid black image was copied to copy paper, and the resultant copied image was observed with the naked eye. The case wherein the copied image was thin and nonuniform was represented by "Observed". The case wherein the copied image was uniform was represented by "None".

Transfer rate

A latent image corresponding to an original solid black image was formed on the photosensitive member, and the latent image was developed with the toner to form a toner image thereon. The toner particles constituting the toner image held by the photosensitive member were entirely recovered and weighed ($W_1$). Further, a toner image was formed on the photosensitive member in the same manner as described above, and then transferred to copy paper. The toner particles constituting the transferred image held by the copy paper were entirely recovered and weighed ($W_2$). The ratio ($W_2/W_1$) of the latter weight ($W_2$) to the former weight ($W_1$) was used as the above-mentioned transfer rate. (Ghost image)

An A-3 size original sample (white-copy sample) only having a black-white pattern in a head portion thereof was copied to copy paper in a half-tone mode. The case wherein the black-white pattern (i.e., a ghost image) was observed in a back portion of the resultant copy paper (i.e., a portion thereof corresponding to the white portion of the original) with the naked eye was represented by "Observed". The case wherein the black-white pattern was not observed in a back portion of the resultant copy paper with the naked eye was represented by "None".

Dark Part Potential

The surface potential of the photosensitive member was measured by means of an electrometer for measuring surface potential (Model 244, manufactured by Monroe Co.) at a position where the transfer charger was disposed opposite to the photosensitive member.

From the above Table 1, it is found that good transfer rates are obtained without a ghost image or back transfer of the toner, when the ratio of the light quantity for the pre-transfer exposure to that for the image exposure is 2 or above, preferably not less than 2 and not more than 10.

Further, for the purpose of comparison, the above-mentioned experiments were repeated in the same manner as described above except that the diffusing plate was not provided in front of the LED array, i.e., scattered light was not used. The thus obtained experimental results are shown in the following Table 2.

TABLE 2

| Ratio of light quantity for pre-transfer exposure to that for image exposure | Back-transfer of toner | Transfer rate (%) | Ghost image | Dark part potential after pre-transfer exposure (V) |
|---|---|---|---|---|
| None | Observed | 89 | None | −600 |
| 1 (3.2 lux.sec) | Slightly observed | 90 | " | −500 |
| 2 | Substantially None | 92 | " | −420 |
| 3 | None | 93 | Slightly observed | −350 |
| 5 | " | 94 | Observed | −230 |
| 10 | " | 96 | " | −100 |
| 20 | " | 96 | " | −50 |

From the above Tables 1 and 2, it is clear that the occurrence of a ghost image and the backtransfer of a toner can be prevented by using scattered light for the pre-transfer exposure.

Example 2

A copying apparatus was assembled in the same manner as in Example 1 except that a fuselamp (a tungsten lamp manufactured by Toshiba K.K. 24 V, 12 lm) was used as a light source for pre-transfer exposure instead of the LED array used in Example 1. Further, the same experiments as in Example 1 were conducted by using the thus obtained copying apparatus. The scattering rate of the scattered light was 1.

The thus obtained experimental results are shown in the following Table 3.

TABLE 3

| Ratio of light quantity for pre-transfer exposure to that for image exposure | Back-transfer of toner | Transfer rate (%) | Ghost image | Dark part potential after pre-transfer exposure (V) |
|---|---|---|---|---|
| None | Observed | 89 | None | −600 |
| 1 (3.2) lux.sec) | Substantially None | 92 | " | −300 |
| 2 | None | 94 | " | −230 |
| 3 | " | 95 | " | −160 |
| 5 | " | 96 | " | −80 |
| 10 | " | 96 | Substantially None | −20 |
| 20 | " | 96 | Observed | −20 |

From the above Table 3, it is found that the occurrence of a ghost and the back-transfer of the toner can be prevented, when the ratio of the light quantity of the pre-transfer exposure to that of the image exposure is 2 or above, preferably not less than 2 and not more than 10, similar to Example 1.

The above-mentioned experiments were repeated in the same manner as described above, while changing the scattering rate of the pre-transfer exposure. The results are shown in the following Table 4.

TABLE 4

| Scattering rate for pre-transfer exposure | Ratio of light quantity for pre-transfer exposure to that for image exposure | Back-transfer of toner | Transfer rate (%) | Ghost image | Dark part potential after pre-transfer exposure (V) |
|---|---|---|---|---|---|
| 0.5 | 5 | None | 94 | Substan- | −300 |

TABLE 4-continued

| Scattering rate for pre-transfer exposure | Ratio of light quantity for pre-transfer exposure to that for image exposure | Back-transfer of toner | Transfer rate (%) | Ghost image | Dark part potential after pre-transfer exposure (V) |
|---|---|---|---|---|---|
| | | | | tially None | |
| 0.7 | 5 | None | 95 | None | −150 |
| 1.0 | 5 | None* | 96 | None | −80 |

From the above Table 4, it is found that the scattering rate is preferably 1, but the occurrence of a ghost image and the back-transfer of a toner can sufficiently be prevented by using a scattering rate of below 1.

Example 3

A copying apparatus was assembled in the same manner as in Example 1 except that a fuse lamp (24 V, 12 lm) was used instead of the LED array used in Example 1, and that a diffusing reflector plate was used instead of the diffusing plate used in Example 1. The diffusing reflector plate used herein was one obtained in the following manner.

$BaSO_4$ powder was dispersed in a solution obtained by dissolving sodium carboxy-methyl cellulose in pure water. The resultant dispersion was applied onto one side of a substrate (10×300 mm) of a polycarbonate resin, by a spray coating method, thereby to obtain the diffusing reflector plate.

Figure 3:
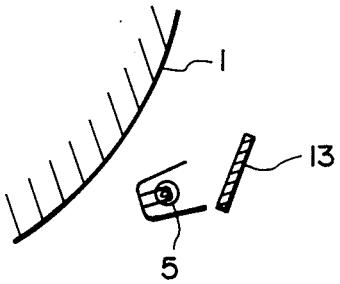
FIG. 3 is a schematic partial side view of an embodiment using a diffusing reflector plate as a means for forming scattered light.

In this instance, as shown in FIG. 3, the light emitted by the fuse lamp 5 was once reflected by the diffusing reflector plate 13 to be converted into scattered light, which was then supplied to the photosensitive member 1 directly, but the light emitted by the fuse lamp 5 was not directly supplied to the photosensitive member 1.

The photosensitive member 1 used herein comprised a photosensitive layer having a laminate structure comprising a charge generation layer and a charge transport layer. More specifically, the photosensitive member 1 was prepared in the same manner as in Example 1, except that the charge generation layer comprised an azo pigment represented by the following formula as a charge-generating material:

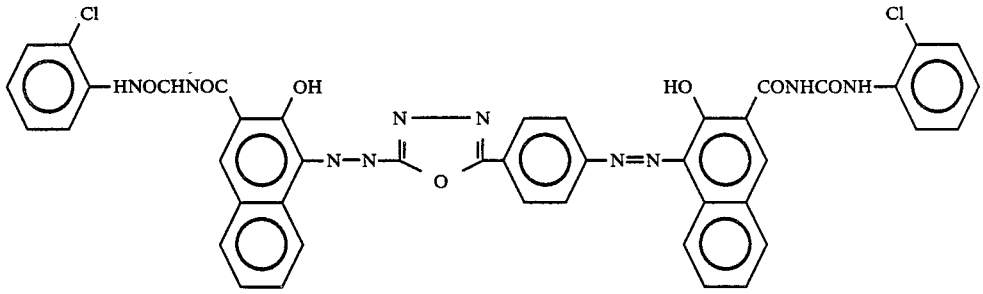

and that the charge transport layer comprised a stilbene compound represented by the following formula as a charge-transporting material:

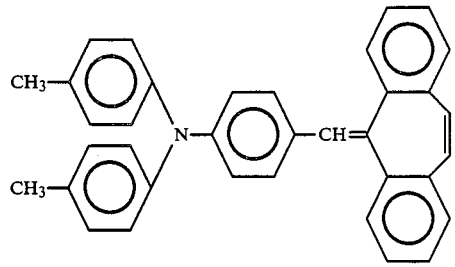

The photosensitive member 1 having such structure was assembled in the above-mentioned copying apparatus. Further, the same experiments as in Example 1 were conducted by using the thus obtained copying apparatus. The scattering rate of the scattered light was 0.9.

The thus obtained experimental results are shown in the following Table 5.

TABLE 5

| Ratio of light quantity for pre-transfer exposure to that for image exposure | Back-transfer of toner | Transfer rate (%) | Ghost image | Dark part potential after pre-transfer exposure (V) |
|---|---|---|---|---|
| None | Observed | 89 | None | −600 |
| 1 (2.1 lux.sec) | Substantially None | 93 | " | −280 |
| 2 | None | 94 | " | −220 |
| 3 | " | 95 | " | −150 |
| 5 | " | 96 | " | −80 |
| 10 | " | 96 | Substantially None | −20 |
| 20 | " | 96 | Observed | −20 |

From the above Table 5, it is found that the occurrence of a ghost image and the back-transfer of a toner can be prevented by using the light quantity for the pre-transfer exposure which is two or more times that for the image exposure, similar to Examples 1 and 2.

As described hereinabove, in an image-forming apparatus wherein the surface of a photosensitive member carrying a toner image is subjected to a pre-transfer exposure before it reaches a transfer position at which the toner image is transferred to a transfer material, an image of good quality can be provided without back-transfer of a toner or occurrence of a ghost image by using, for the pre-transfer exposure, scattered light having a light intensity which is at least twice that for the image exposure.

What is claimed is:

1. An image-forming apparatus including: a photosensitive member having a photosensitive layer comprising an organic photoconductive material, said apparatus including a charging means, an image exposure means for exposing the photosensitive member to form a latent image, a developing means for developing the latent image with a toner to form a transferable toner image on the surface of the photosensitive member, a pre-transfer exposure means for exposing the photosensitive member carrying the toner image, and a transfer means for transferring the toner image to a transfer material; said charging means, image exposure means, developing means, pre-transfer exposure means, and transfer means being disposed in this order along the moving direction of the photosensitive member;

wherein the light from said pre-transfer exposure means is scattered light and the intensity of the scattered light is two or more times that of the light used for the image exposure exerted by said image exposure means.

2. An apparatus according to claim 1, said scattered light being obtained by scattering light emitted by a light source for the pre-transfer exposure by a scattering means.

3. An apparatus according to claim 2, wherein said scattering means comprises a diffusing plate or a diffusing reflector plate.

4. An apparatus according to claim 1, said scattered light being obtained by scattering light emitted by a line source by a scattering means comprising a diffusing plate or a diffusing reflector plate, thereby using the scattering means as a surface illuminant.

5. An apparatus according to claim 4, the line source being selected from a fuselamp, a line filament lamp, and an LED array.

6. An apparatus according to claim 1, the light intensity for the pre-transfer exposure being 10 or less times that for the image exposure.

7. An apparatus according to claim 1, the light intensity for the pre-transfer exposure being 5 or less times that for the image exposure.

* * * * *

UNITED STATES PATENT AND TRADEMARK OFFICE

CERTIFICATE OF CORRECTION

PATENT NO. : 4,853,736 Sheet 1 of 3

DATED : August 1, 1989

INVENTOR(S) : KOJI GOTO, ET AL.

It is certified that error appears in the above-identified patent and that said Letters Patent is hereby corrected as shown below: Title page:

IN THE ABSTRACT:

Line 4, "devices" (both occurrences) should read --device--;

Line 6, "devices" should read --device--;

Line 9, "devices" should read --device--;

Line 10, "devices" should read --device--;

Line 12, "devices" (both occurrences) should read --device--;

Line 13, "devices" (both occurrences) should read --device--;

Lines 13-14, "devices" should read --device--;

Line 16, "devices" should read --device--;

Line 19, "devices" should read --device--.

COLUMN 1, line 14, "a" should read --an--;

line 62, "example" should read --example,--.

UNITED STATES PATENT AND TRADEMARK OFFICE

CERTIFICATE OF CORRECTION

PATENT NO. : 4,853,736 Sheet 2 of 3

DATED : August 1, 1989

INVENTOR(S) : KOJI GOTO, ET AL.

It is certified that error appears in the above-identified patent and that said Letters Patent is hereby corrected as shown below:

COLUMN 2, line 28, "used practically" should read --used:--;

line 32, "4,356,243, 4,471,040" should read --4,356,243 and 4,471,040--; same line, "etc." should be deleted;

line 34, "etc." should be deleted.

COLUMN 3, line 54, "prsent" should read --present--.

COLUMN 6, line 2, "line to" should read --line tangent to--.

COLUMN 8, line 16, "In, in" should read --In--;

line 37, "(Back-transfer)" should be on the next line as a heading;

UNITED STATES PATENT AND TRADEMARK OFFICE

CERTIFICATE OF CORRECTION

PATENT NO. : 4,853,736 Sheet 3 of 3

DATED : August 1, 1989

INVENTOR(S) : KOJI GOTO, ET AL.

It is certified that error appears in the above-identified patent and that said Letters Patent is hereby corrected as shown below:

COLUMN 9, line 6, "(Ghost image)" should be on new line as a heading;

Signed and Sealed this

Nineteenth Day of June, 1990

*Attest:*

HARRY F. MANBECK, JR.

*Attesting Officer*

*Commissioner of Patents and Trademarks*